United States Patent [19]

Svoboda

[11] 4,310,010

[45] Jan. 12, 1982

[54] APPARATUS FOR CLEANING CLOSED-END TUBES

[76] Inventor: Melora J. Svoboda, 1525 Beechwood La., Grafton, Wis. 53024

[21] Appl. No.: 110,209

[22] Filed: Jan. 7, 1980

[51] Int. Cl.[3] ..... B08B 9/08

[52] U.S. Cl. ..... 134/135; 134/92; 134/170; 134/171; 134/201; 15/302; 15/304

[58] Field of Search ..... 134/106, 135, 166 R, 134/170–171, 198, 117, 22 R, 84, 92, 201; 15/302, 304

[56] References Cited

U.S. PATENT DOCUMENTS

| | | | |
|---|---|---|---|
| 2,872,364 | 2/1959 | Sherwood et al. | 134/22 R UX |
| 3,128,780 | 4/1964 | Worrell | 134/201 |
| 3,384,100 | 5/1968 | Ross et al. | 134/166 R |
| 3,849,830 | 11/1974 | Wagner | 134/171 X |

FOREIGN PATENT DOCUMENTS

| | | | |
|---|---|---|---|
| 856449 | 12/1960 | United Kingdom | 134/166 R |

*Primary Examiner*—Robert L. Bleutge
*Attorney, Agent, or Firm*—Harry B. Keck

[57] ABSTRACT

A two-chambered cleaning device includes an upper chamber and a lower chamber separated by a generally horizontal perforated plate. Generally vertical openings extend through the horizontal plate constituting the perforations which receive generally vertical open tubes extending above the horizontal plate into the upper chamber. The vertical open tubes receive the open ends of closed-end tubes which are to be cleaned. A cleaning liquid is introduced into the upper chamber, above the horizontal plate. The pressure in the lower chamber is reduced below that of the upper chamber whereby the cleaning fluid passes upwardly through the annular space between the outer surface of the vertical open tubes and the inner surface of the closed-end tubes which are to be cleaned.

6 Claims, 3 Drawing Figures

APPARATUS FOR CLEANING CLOSED-END TUBES

BACKGROUND OF THE INVENTION

1. Field of the Invention

This invention relates to apparatus for cleaning closed-end tubes with a cleaning liquid.

2. Description of the Prior Art

Closed-end tubes are employed in various chemical laboratory apparatus for confining specimens under observation. Such tubes are relatively expensive and warrant cleaning after each use to permit additional uses. At present such closed-end tubes are cleaned by spraying fine-jet streams of cleaning fluid into each tube individually or by brushing the interior with fine wires or rods in the presence of cleaning liquids. Such cleaning methods are tedious, slow activities which do not permit cleaning multiple closed-end tubes at one time and also result in appreciable breakage of the closed-end tubes. These methods also present a hazard from possible glass breakage, from exposure of the operator's skin to harsh cleaning fluids and from prolonged breathing of cleaning fluid vapors by the operator.

SUMMARY OF THE INVENTION

The principal object of this invention is to provide apparatus which eliminates the tedium from the job of cleaning closed-end tubes without introducing a significant breakage tendency and which permits the cleaning of one or many such tubes at the same time.

A further object is to provide apparatus for cleaning closed-end tubes which permits the cleaning of a desired number of closed-end tubes, which may be a different number for each operation.

A further object is to provide apparatus for cleaning closed-end tubes which is simple and inexpensive to assemble and to operate.

By "closed-end tubes", I am particularly concerned with chemical analytical closed-end tubes which typically have an inner diameter of ⅛ inch and a length of about 7 inches. Such closed-end tubes are employed ib nuclear magnetic resonance (NRM) analysis. The present apparatus also might be employed to clean conventional chemical laboratory test tubes and glass or plastic ampoules, if desired.

According to this invention, a two-chambered cleaning device is provided which includes a generally horizontal perforated plate separating an upper chamber from a lower chamber. The perforations of the horizontal plate are with open vertical tubes or are stoppered with plugs, with rods or with stoppered tubes. The vertical open tubes are employed for cleaning closed-end tubes. The unit has as many vertical open tubes as there are closed-end tubes to be cleaned. Those perforations in the horizontal plate which are not required for a vertical open tube will be stoppered as described.

Perimeter sealing means are provided to prevent communication between the upper chamber and the lower chamber around the perimeter of the horizontal plate. The closed-end tubes, to be cleaned, are placed, one each, on a vertical open tube by sliding the closed-end tube vertically downwardly. An annular space is provided between the inner surface of the closed-end tube and the outer surface of the contained vertical open tube. The length of the vertical open tube is approximately the same as the length of the closed-end tube.

After all of the available vertical open tubes are covered with a closed-end tube, the upper chamber is filled with a reservoir of cleaning liquid which may be an organic solvent or water containing a suitable cleansing detergent, or other liquid reagent.

The pressure between the upper chamber and the lower chamber is adjusted so that the lower chamber has a lower pressure than the upper chamber. Thereupon the cleaning liquid is drawn upwardly through the annular passages between each vertical open tube and its covering closed-end tube, and thence down through the bore of each vertical open tube into the lower chamber. The spent cleaning fluid may be recovered from the lower chamber for re-use or may be discarded. The absolute pressure difference between the upper chamber and the lower chamber influences the velocity of liquid flow through the annular passageways and thus influences the cleaning action of the unit.

DESCRIPTION OF THE PREFERRED EMBODIMENT(S)

Figure 1:
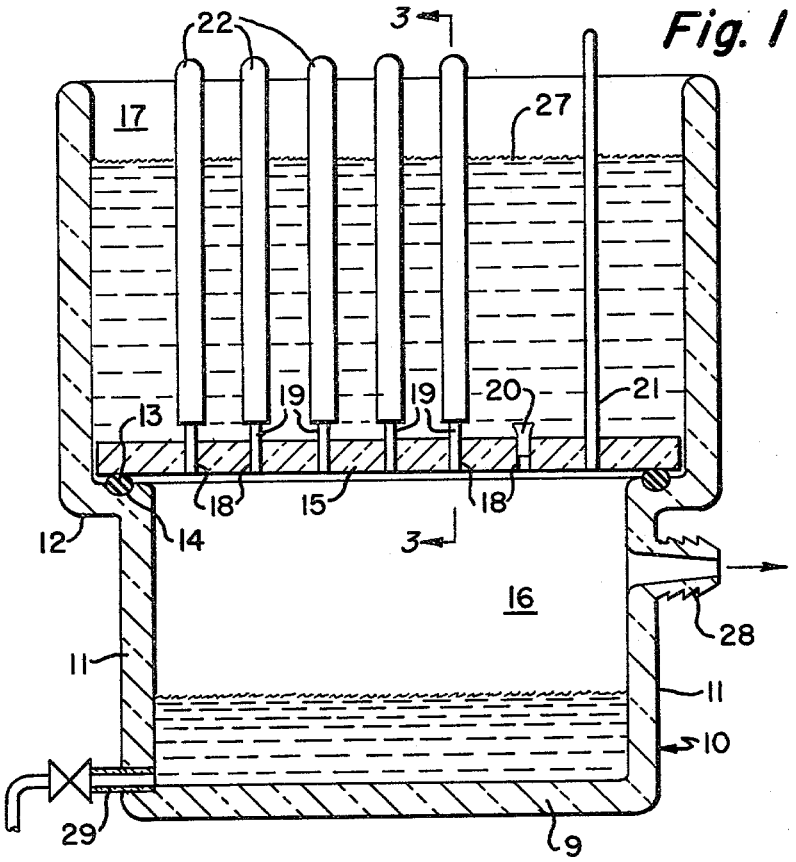
FIG. 1 is a cross-section view of one embodiment of the apparatus for carrying out the present invention.

Referring to FIG. 1, there is illustrated a vessel 10 having a bottom wall 9, upstanding side walls 11 with an outwardly presented shoulder 12. An O-ring 13 rests in a groove 14 in the shoulder 12. A horizontal plate 15 rests adjacent to its perimeter on the O-ring 13.

The horizontal plate 15 divides the interior of the vessel 10 into a lower chamber 16 and an upper chamber 17. The O-ring 13 prevents flow of liquids or gases from the upper chamber 17 downwardly over the shoulder 12 into the lower chamber 16.

The horizontal plate 15 has multiple vertical openings 18 which are adapted to engage the bottom ends of vertical open tubes 19 or suitable stoppers 20 or suitable rods 21. In a preferred embodiment, the vertical open tubes 19 are press-fit into the openings 18.

Figure 3:
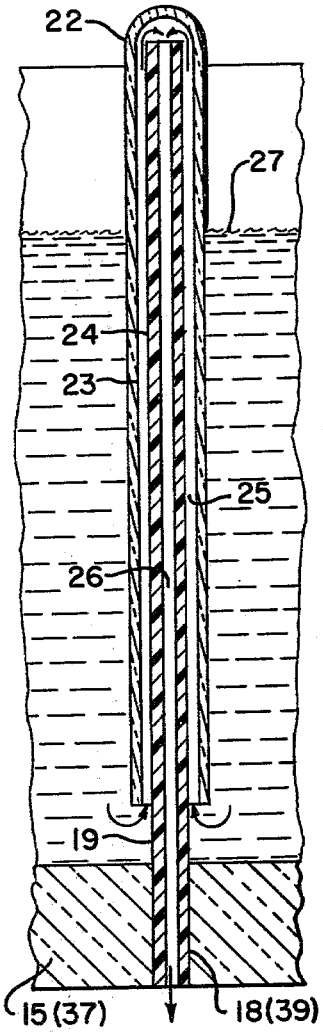
FIG. 3 is an enlarged cross-section view taken along the long 3—3 of FIG. 1 and FIG. 2.

When the system is employed for cleaning NMR closed-end tubes, the vertical open tubes 19 have an outer diameter less than 3/16 inch and a length of 6–9 inches. Typical closed-end tubes 22 are shown (FIGS. 1 and 3) as they appear when the unit is operating. The closed tubes 22 have an inner surface 23 which is greater than the outer surface 24 of the associated vertical open tube 19 whereby an annular passage 25 is presented which is open at the bottom and which communicates with the lower chamber 16 through the bore 26 or the vertical open tubes 19. The annular passage 25 preferably is less than 1/32 inch wide.

After all of the openings 18 are stoppered or fitted with vertical open tubes 19 and closed-end tubes 22, a reservoir of cleaning liquid 27 is poured into the upper chamber 17. The cleaning liquid 27 cannot flow to the lower chamber 16 except through annular passages 25 and the bores 26 of the vertical open tubes 19.

In the preferred embodiment, the pressure in the lower chamber 16 is reduced below that of the upper chamber 17 by evacuating the contents (normally air) of the lower chamber 16 through an exhaust passageway 28. Conveniently the exhaust passageway 28 will be connected through a flexible tubing (not shown) to an aspirator. Only a very slight change in pressures between the lower chamber 16 and the upper chamber 17 will cause the cleaning liquid 27 to flow through the annular passages 25 and thereby clean the closed-end tubes.

Preferably the vessel 10 and horizontal plate 15 are fabricated from transparent or translucent materials such as glass or plastics to permit the operator to observe the progress of the cleaning operation. The horizontal plate 15 may have as many vertical openings 18 as the unit requires. A unit with twenty-five vertical openings 18 has been found to be useful. The operator accumulates used closed-end tubes until a sufficient number is presented to warrant multiple cleaning.

The spent cleaning fluid is retained in the lower chamber 16 and, when desired, withdrawn through an outlet 29 for re-use or disposal.

Figure 2:
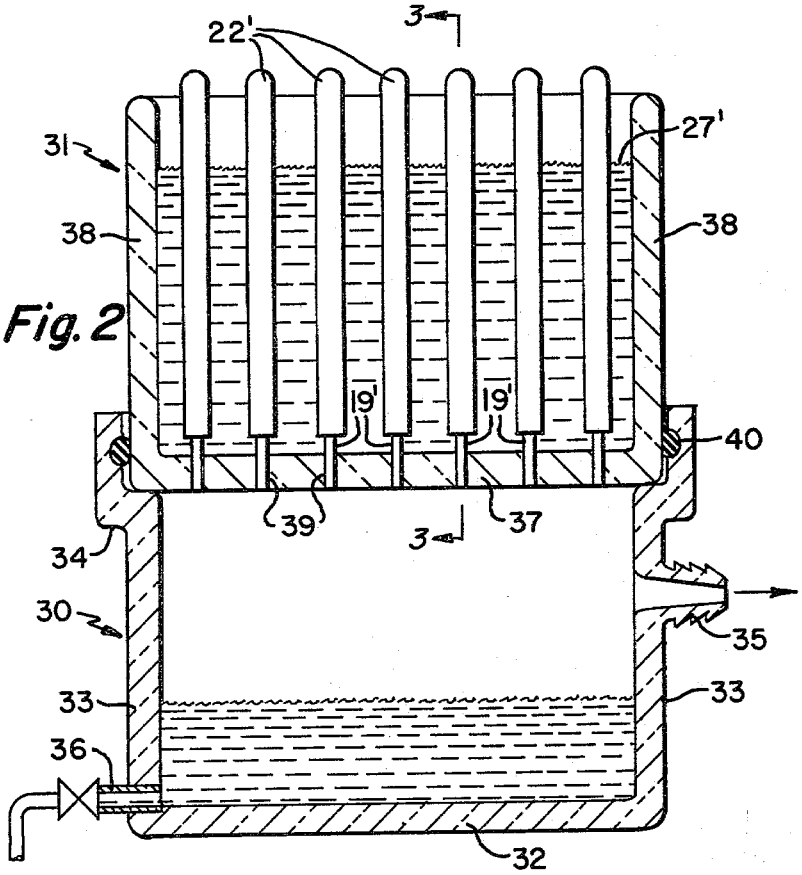
FIG. 2 is a cross-section view of a preferred embodiment of apparatus for carrying out the present invention.

A preferred embodiment of the invention, shown in FIG. 2, employs an open-top bottom container 30 and an open-top upper container 31. The open-top bottom container 30 has a bottom wall 32, upstanding side walls 33, a shoulder 34, a gas-removing outlet 35 and a fluid outlet 36. The open-top upper container 31 has a bottom wall 37 and upstanding side walls 38. The open-top upper container 31 fits within the top portion of the open-top bottom container 30. The bottom wall 37 of the open-top upper container 31 serves the same function in the device of FIG. 2 as the horizontal wall 18 in the device of FIG. 1. The bottom wall 37 has multiple vertical openings 39 which are analogous to the openings 18, described in relationship to FIG. 1. Vertical open-end tubes 19' and closed end tubes 22' (which are to be cleaned) are illustrated. A suitable sealing means such as an O-ring 40 is provided to maintain a seal between the bottom wall 37 and the bottom container 30. A cleaning fluid 27' is supplied to the upper container 31 for withdrawal from the upper container 31 to the bottom container 30 in the manner described in relationship to FIG. 3, whereby the cleaning fluid cleans the closed-end tubes 22'.

I claim:

1. A cleaning device for closed-end tubes, said device having a lower chamber and an upper chamber;

a generally horizontal removable plate separating the said lower chamber from the said upper chamber;

plural, generally vertical openings in the said horizontal removable plate;

vertical open tubes presented in the said upper chamber, each having one end engaged with one of the said vertical openings whereby the bore of each said vertical open tube constitutes a passageway between the said upper chamber and the said lower chamber;

means for establishing a pressure within the said lower chamber which is less than the pressure in the said upper chamber;

each said vertical open tube being adapted to receive and support a closed-end tube with inner surface annularly spaced-apart from the outer surface of the supporting vertical open tube.

2. A cleaning device as described in claim 1 wherein a vessel is provided having a bottom wall, vertical side walls, an outwardly presented shoulder in said vertical side walls supporting the perimeter of said horizontal plate.

3. The cleaning device as described in claim 2 wherein an O-ring is presented between the said shoulder and the perimeter of the said horizontal plate.

4. A cleaning device as described in claim 2 wherein the said outwardly presented shoulder is presented at an intermediate level of said vertical side wall whereby the said vertical side wall below said shoulder defines a side wall of said lower chamber and said vertical side wall above said shoulder defines the side wall of said upper chamber.

5. A cleaning device as described in claim 1 wherein an open-top bottom container is the said bottom chamber and an open-top upper container is the said upper chamber; and wherein the said open-top upper chamber has a bottom wall which constitutes the said horizontal plate; and wherein the said open-top upper container fits within the top portion of the said open-top bottom container.

6. A cleaning device as described in claim 1 wherein the said upper chamber is an open top container defined by upstanding side walls and a generally horizontal bottom wall in which the said bottom wall is the horizontal plate; and said lower chamber is an open top container having side walls and a bottom wall; and wherein said open top upper container fits into the top portion of said open top bottom container.

* * * * *